US006626234B2

(12) United States Patent
Koenig

(10) Patent No.: US 6,626,234 B2
(45) Date of Patent: Sep. 30, 2003

(54) COIL CAPACITY MODULATOR

(76) Inventor: Robert Peter Koenig, 1720 W. 115 Cir., Westminster, CO (US) 80234

( * ) Notice: Subject to any disclaimer, the term of this patent is extended or adjusted under 35 U.S.C. 154(b) by 199 days.

(21) Appl. No.: 09/870,523

(22) Filed: Jun. 1, 2001

(65) Prior Publication Data

US 2003/0159801 A1 Aug. 28, 2003

(51) Int. Cl.[7] ..... F28F 27/02; F24F 3/08; F24F 3/06

(52) U.S. Cl. ..... 165/96; 165/50; 165/101; 165/103; 165/48.1; 237/70; 237/71

(58) Field of Search ..... 165/96, 100, 101, 165/103, 48.1, 50; 237/70, 71, 59

(56) References Cited

U.S. PATENT DOCUMENTS

| | | | | | |
|---|---|---|---|---|---|
| 386,556 | A | * | 7/1888 | Prall | 237/70 |
| 614,658 | A | * | 11/1898 | Leitch | 237/70 |
| 839,561 | A | * | 12/1906 | Davis | 165/96 |
| 869,042 | A | * | 10/1907 | Andrews | 165/96 |
| 1,799,107 | A | * | 3/1931 | Lobelle | 165/101 |
| 1,830,719 | A | * | 11/1931 | Rollins | 165/101 |
| 2,261,596 | A | * | 11/1941 | Stroobauts | 165/96 |
| 3,195,622 | A | * | 7/1965 | Haufler et al. | 165/101 |
| 3,211,375 | A | * | 10/1965 | Prokupek et al. | 165/103 |

FOREIGN PATENT DOCUMENTS

| | | | | |
|---|---|---|---|---|
| CH | 406572 | * | 8/1966 | 237/59 |
| DE | 615237 | * | 6/1935 | 237/70 |
| GB | 306010 | * | 2/1929 | 165/101 |
| GB | 686064 | * | 1/1953 | 165/103 |
| GB | 1052095 | * | 12/1966 | 237/59 |

* cited by examiner

*Primary Examiner*—John K. Ford
(74) *Attorney, Agent, or Firm*—John P. Halvonik

(57) ABSTRACT

A coil modulator apparatus for use in connection with heat transfer coil assemblies found in commercial heating and air conditioning units is used to divert passage of water flow in certain sections of each tube in the coil assembly. The coil modulator apparatus comprises an inner valve, having valve ports in the sides of the valve, that rotates within an outer housing. Apertures in the outer housing connect with each tube in the bank of tubes so that there is an aperture in the outer housing that connects with both the downstream tube section and the upstream tube section of each tube. A portion of the water that collects in the modulator then flows back out of the modulator and into each of the downstream sections of every tube in the coil assembly. Another portion of the water in the modulator is diverted from the bank of tubes so that it flows out of the bypass tube of the modulator and directly back to the return feed of the coil assembly unit.

1 Claim, 3 Drawing Sheets

COIL CAPACITY MODULATOR

FIELD AND BACKGROUND OF THE INVENTION

The invention relates primarily to the field of air conditioning and in particular those HVAC systems that utilize a series of heating and cooling coils, known as a coil assembly, to transfer heat to or from the air stream in the unit. A coil assembly is really a bank of tubes, with each tube known as a "tube face" or may be referred to as simply a "tube" in this application.

The invention involves a sleeve type inner valve that works in conjunction with ports in the outer body and each of the tubes in the bank of tubes to divert a portion of the water flowing in the tubes and send it back to the outlet manifold that collects water from the entire bank of tubes. In this manner, the heat transfer capacity of the unit can be varied without having to vary the overall flow of water through the inlet manifold (albeit water flow in sections of the individual tubes is varied in accordance with the invention).

The system is believed to find its greatest use in commercial building types of applications where large heating/ac units are used to heat and cool buildings. The design of such heating/ac units results in a bank of heat transfer tubes that is fed by an Inlet manifold. In prior art the flow of water through the tubes connected to the manifold remains unblocked at all times hence, the number of passages through the bank of tubes is unrestricted. This means that when less than design volume is required, the overall flow of water at the inlet manifold is reduced which results in tubes in the bank getting uneven and disproportionate flow. This results in cycling of temperature, laminar flow, stratification and inefficient operation.

It is found that during the majority of operating hours, the actual amount of water flow through the coil is less than 25% of the calculated design flow requirement. Such units typically operate with this increment of water flowing through the tubes of the unit, much if not all of the normal day. The resulting condition (excess heat transfer capacity under part load) means that only a fraction of the tubes in the coil actually have significant water flow for the reason discussed above.

The over capacity at part load thus causes cyclic control resulting in hot and cold temperature swings throughout the day which prompts complaints from the occupants. This of course means, more building maintenance calls, perhaps more fine tuning of thermostats and discomfort for occupants prompting costly fixes designed for short term alleviation of the problem.

It is the object of the invention to avoid these temperature swings by closing off certain sections of each tube in the coil assembly when such are not needed and thus insuring that the volume of water flow through the unit is uniformly distributed by design while the effective heat transfer capacity of the entire unit varies as the demand warrants it. By short circuiting or bypassing some of the sections of the tubes in the coil (reducing the effective heat transfer surface) the same volume of water can flow through the unit but with diminished heat transfer capacity.

Since coil assemblies are used for heating and cooling they can be dedicated to one or the other or used for both. A single assembly can serve both functions where the heating and cooling medium is switched from one to the other as required to satisfy building requirements. In either case the ports can be characterized to satisfy a variety of flow requirements. A major advantage is realized in the ability to change the heat transfer capacity when a single coil is used for both cooling and heating where the required transfer surface for heating is much less than for cooling. The modulator effectively modifies the design characteristic and heat transfer capacity of the coil by changing the amount of active heat transfer surface.

The invention performs this function by means of a sleeve type inner valve that cuts off or blocks flow to a portion of each tube row in response to a control device detecting that full volume flow is not required. Thus, the invention restricts flow through certain sections of each and every tube in the tube bank when such flow is not needed and thereby minimizes the potential cycling of temperature in the unit when such flow is not restricted.

SUMMARY OF THE INVENTION

A coil modulator apparatus for use in connection with heat transfer coil assemblies found in commercial heating and air conditioning units. The coil modulator apparatus comprising an inner valve, having valve ports in the sides of the valve, that rotates within an outer housing. Apertures in the outer housing connect with each tube in the bank of tubes so that there is an aperture in the outer housing that connects with both the downstream tube section and the upstream tube section for every tube in the bank of tubes that comprise the coil assembly. Water in the coil assembly, flowing in the upstream section of a tube, thus travels out of the upstream section and into the coil modulator when the modulator is opened and in use.

All or a portion of the water that collects in the modulator then flows back out of the modulator and into each of the downstream sections of every tube in the coil assembly. Another portion of the water in the modulator is diverted from the bank of tubes so that it flows out of the bypass tube of the modulator and directly back to the return manifold of the coil assembly unit. Rotation of the inner valve of the modulator varies the effective flow of water flowing through the downstream section of each tube in the assembly. Flow is varied in accordance with the heat transfer needs of the building.

Thus the use of the coil capacity modulator means that water flow to the coil supply manifold need not be varied to meet the different needs of the building. Heat transfer capacity is varied by diverting a portion of the water out of each tube in the bank so that the overall volume of water in the upstream section of the tube does not change but the volume in the downstream section does. This results in an equal flow or designed volume of water in every tube in the coil assembly. The overall volume of water flowing in the inlet and outlet manifolds will depend on the location and characterization of the inner valve ports (see FIG. 10).

It is an object of the invention to provide an improved heat transfer unit that maintains relatively high flow in the upstream section while modulating the flow rate in the individual downstream sections of each tube in the coil assembly.

Another object of the invention is to provide a modulator for varying the heat transfer capacity of the coil in an heating/ac unit without having to vary the overall volume of water flowing through the coil for freeze protection when used for heating and to provide chiller flow protection when used for cooling.

Another object of the invention is preventing the cycling of building temperatures that result when the design heat transfer capacity of the coil assembly exceeds the amount of heating or cooling necessary to meet demand (over capacity at part load). This is the condition that exists in coil applications when the volume of water to the supply manifold is decreased to effect a reduced heat transfer and the active transfer surface area remains constant.

Another object of the invention is to eliminate stratification by uniformly distributing water through selected tubes when the coil is operating under reduced load and the flow rate is significantly below design conditions.

Another object of the invention is to provide more efficient air conditioning of buildings by maintaining uniform flow through a portion of each row in the assembly for freeze protection while reducing or stopping flow in another section of the tube row to reduce total heat transfer capacity of the unit.

Another object of the invention is to increase the heat transfer capacity of the coil assembly in reverse proportion to the flow rate to maintain a relatively high temperature differential by characterizing and locating ports in the inner valve to reduce total volume by closing upstream ports of selected tubes and opening ports in the modulator to allow flow from the modulator through selected downstream tubes. The result is reduced flow and increased heat transfer to raise water temperature going through the coil to improve chiller efficiency when the system is operating at part load in the cooling mode.

Another object of the invention is to minimize the need to employ pumps to ensure uniform distribution of water during periods of low demand and when two or more coils are used in parallel. By varying all tube openings discretely the coil capacity modulator ensures uniform distribution in all active tubes and minimizes the problem associated with laminar flow. The coil capacity modulator facilitates maintaining a relatively high and uniform tube velocity at part load compared to prior art.

Other objects of the invention will become apparent to those skilled in the art once the invention has been shown and described.

DESCRIPTION OF THE PREFERRED EMBODIMENT

Figure 1:
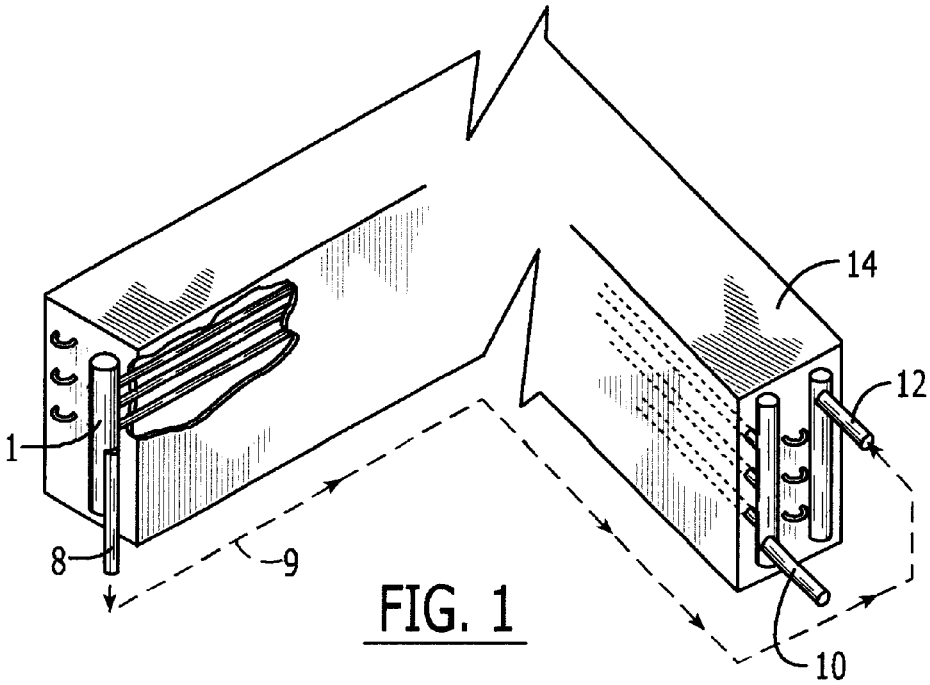
FIG. 1 overall construction of standard coil housing in connection with the coil capacity modulator.

The overall construction of the assembly as shown in FIG. 1. The coil capacity modulator 1 is the improved part of the coil assembly system. The modulator is the subject of the invention and it is an apparatus designed to be included in the manufacture of new and retrofit to standard multi pass coil assemblies (shown as 14 in FIG. 1).

The standard coil housing 14 is essentially a plurality of serpentine tubes for transferring heat in a heating/ac system. See FIG. 6. There is an inlet manifold 10 and outlet manifold 12 in connection with this bank of tubes. The inlet and outlet manifolds may be referred to as supply and return tubes. One inlet manifold feeds all the tubes in the bank by feeding water into a downstream section of each tube and the outlet manifold collects water from all the tubes in the bank coming from an upstream section of tube.

An upstream section (e.g. section 24 in FIG. 6) of tube is merely a section where the water is flowing away from the end (of the bank of tubes) where the inlet manifold is and a downstream section (e.g. section 22 in FIG. 6) is where water is flowing toward that and where the inlet (and outlet) manifold is located. The modulator may be placed between any upstream and downstream section.

In prior art systems, the volume of water to the inlet manifold is decreased or increased in response to demand of the system with an increased volume of water needed on an increase in demand and a decrease when the demand decreases.

Because of this arrangement, tubes in the bank of tubes (i.e. the tubes in the coil assembly 14 FIG. 1) receive disproportionate water flow rates resulting in significant temperature variation in the leaving air stream (stratification). This is a problem that past art heating/ac systems experience by varying degree; many to the degree than occupant comfort and performance as well as system performance and efficiency is affected.

The upstream section (24 FIG. 6) of a tube is connected to the supply tube or inlet manifold 10 and water flows through this section all the way to the end of the bank farthest from the supply tube where it makes a turn. The downstream section (22 FIG. 6) is for the return of water in the coil bank to the outlet manifold 12. The water in each tube reaches the end of the bank and returns through the bank via a downstream section of the tube. Water reaches that end (of the bank of tubes) where it started and exits the bank of tubes via the return tube 12.

It is possible that any single tube may have more than one upstream and downstream section within the row, that is each tube may be of a serpentine construction so that the water flows to one end and back to the other end a number of times before it finally exits through the return tube. However the case may be, there will usually be an odd number of turns in the tube so that water will return back to the same end where it started. The simplest tube in the bank would have one turn, and hence one upstream and one downstream section. A more tortuous tube might have three turns like that shown in FIG. 6 so that the water changes direction in the bank three times, with the last turn, returning back to the end it started from.

But note: There is only one supply manifold 10 and one return manifold 12 for the entire bank of tubes. Briefly, the add on modulator will go at one end of this bank of tubes (or "coil housing") and will divert a portion of the water flowing in each of the tubes in the bank and send that portion directly (via bypass line 9) to the return manifold 12 or system return without going through the downstream section(s) of the tube. (See discussion to follow).

Figure 6:
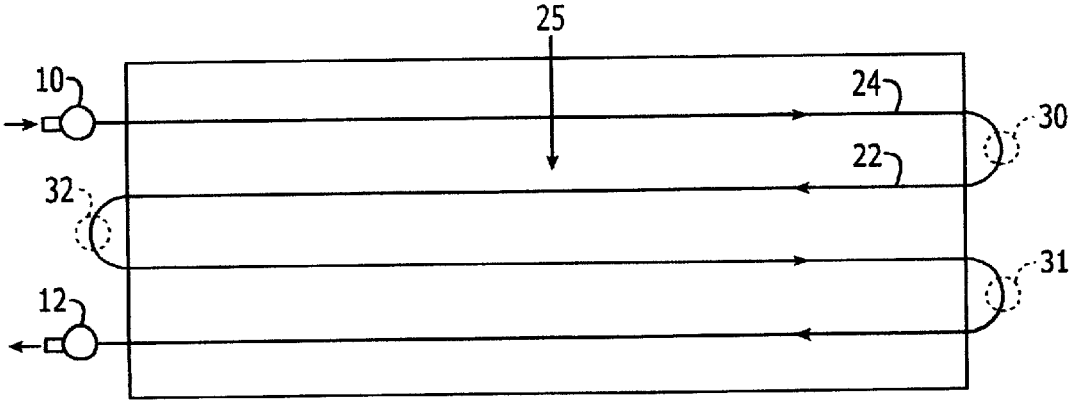
FIG. 6 detail of serpentine construction of a single tube in the bank of tubes that comprise a coil assembly and alternate placement of the coil capacity modulator.

To understand the connection between the modulator and the individual tubes in the bank, a closer look at a single tube in the bank is needed. In FIG. 6 can be seen the serpentine construction of a single tube in the bank of tubes that comprise the coil assembly. The arrows within the assembly 14 shows direction of flow of water while the arrow at 25 show direction of air flow. This tube has 3 turns in it (one is indicated at 15). An upstream section is one of those like section 24 and a downstream section one of those like section 22. Numbers 30, 31 and 32 refer to optional placements of the modulator.

In standard units (and also in those units that will feature the applicant's invention), water arrives at the assembly by a single supply tube 10 (or inlet manifold) that feeds the bank. Water is fed to the manifold by a pump(s) generating differential pressure between the supply and return mains of the distribution system. Water is fed to each of the working tubes in the bank by this vertically oriented manifold 10. Each tube in the bank of tubes has at least one upstream and a downstream section, sometimes more. The one in FIG. 6 has two upstream and two downstream sections if located at position 32. In any event, the modulator is versatile with regard to location.

The coil capacity modulator shown in FIGS. 1–5 is essentially a valve for varying the flow of water through at least one of the downstream sections of each of those tubes in the coil housing 14 (where a single one of those tubes is shown in FIG. 6). The modulator may be located at the end of the bank opposite where the inlet and outlet manifolds are (see position 30 and 31 in FIG. 6) or it may be at the same end (see position 32 in FIG. 6).

Figure 2:
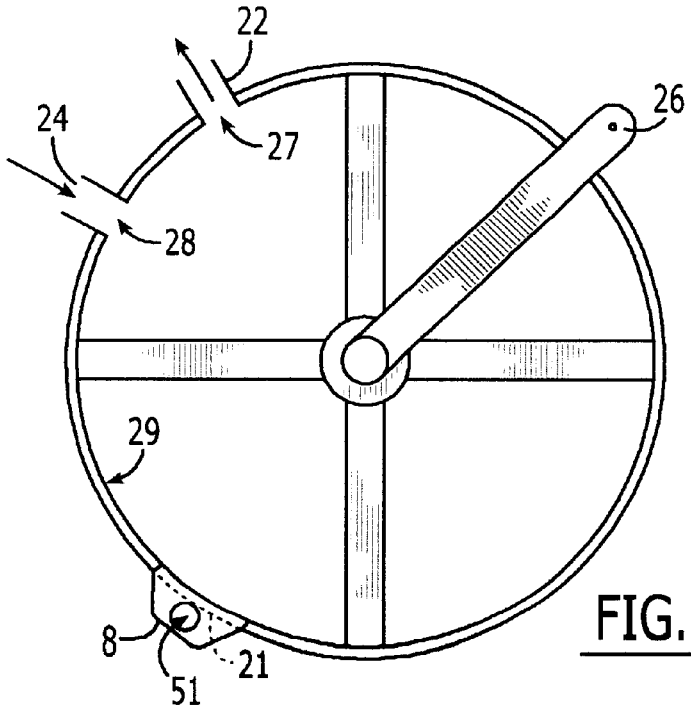
FIG. 2 cross section of coil capacity modulator.
Figure 3:
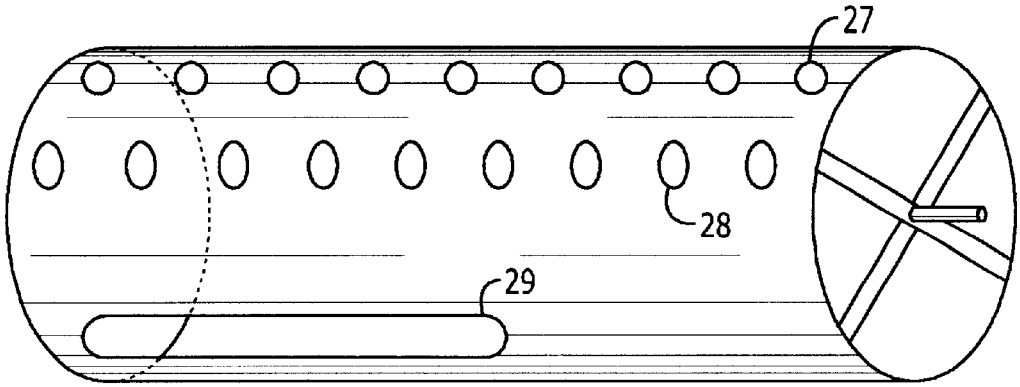
FIG. 3 detail of inner valve body.
Figure 4:
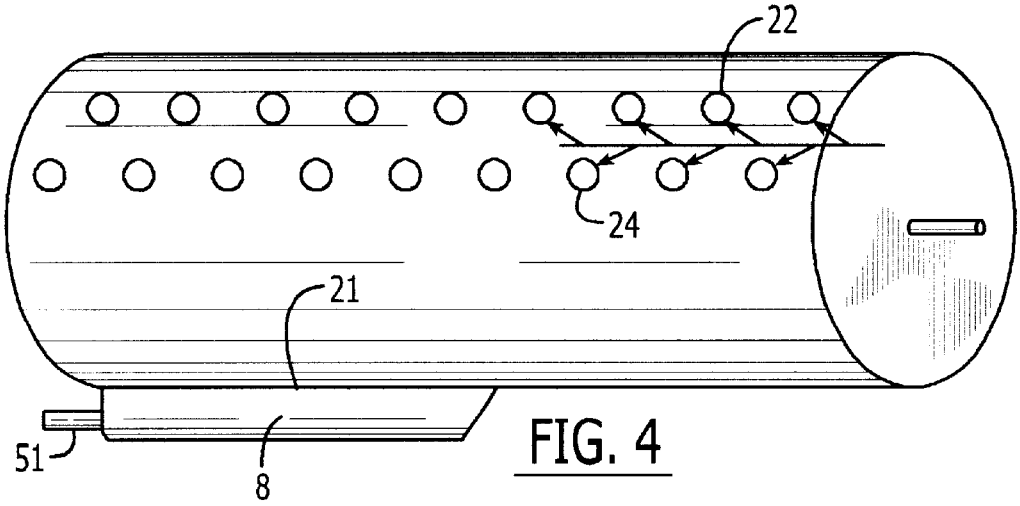
FIG. 4 detail of outer valve body.
Figure 5:
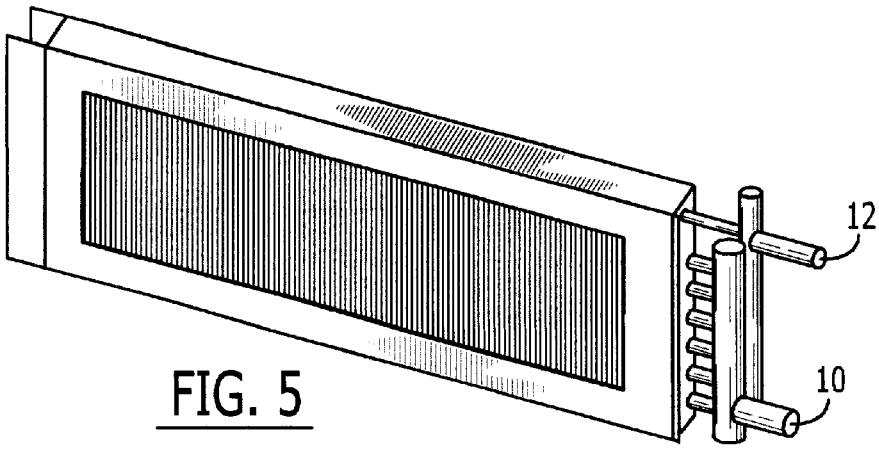
FIG. 5 standard coil housing without the improved apparatus.

However many turns there are in a tube, the ports in the outer body of the modulator need to be connected to a downstream (port 22) and an upstream tube section (port 24) in FIG. 2. A downstream tube section and an upstream tube section is shown in connection with those ports on the outer body of the modulator in FIG. 4.

Figure 7:
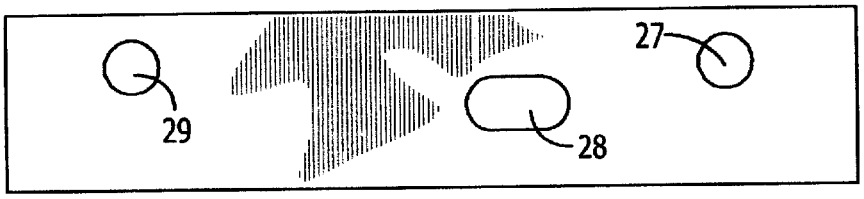
FIG. 7 view of inner valve openings (flat layout of ports 27, 28 & 29).
Figure 10:
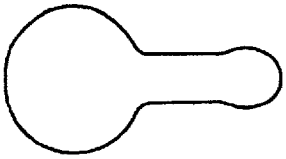
FIG. 10 example of possible port shape (characterization).

There are a pair of ports (22 and 24 in FIG. 4) in the outer valve body corresponding to a downstream and an upstream tube section for every tube in the bank of tubes. There are openings (27 and 28 in FIG. 3) in the inner valve that correspond to those outer valve body ports so that rotation of the inner valve will vary the position of the ports 27, 28 and 29 in relation to ports 22, 24 and 21. Thus by rotating the inner valve (e.g. by actuator arm 26 FIG. 2) the effective size of the opening between inner valve and outer body will vary. The ratio of free area to degrees of rotation depends on the characterization (shape) of the inner valve port(s) FIG. 7. A round/oval shape is shown. See FIG. 10 for example of characterized shape. Port characterization is an engineering function allowing customized flow characteristics for each tube in the tube bank.

Figure 9:
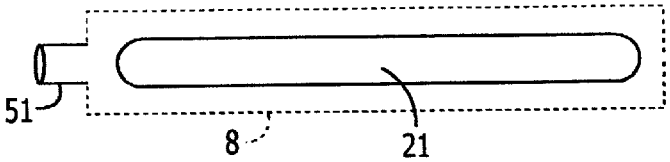
FIG. 9 shows the detail of the bypass accumulator and port 21.

Thus water will pass into the modulator through the openings 24 in the outer valve body and 28 in the inner valve. Depending on the positioning of the inner valve ports with respect to the outer valve ports all of the water entering will pass out of the modulator through ports 22 in the outer valve body and 27 in the inner valve when these ports are aligned. Rotation of the inner valve will vary the port alignment so a portion of, or all of this water can be diverted directly back to the outlet manifold through port 29 in the inner valve and port 21 in the outer valve body via bypass accumulator 8 shown in FIG. 4 and bypass line 9 shown in FIG. 1. Adapter 51 facilitates connecting accumulator 8 to bypass line 9. In this manner, the flow of water in the downstream portion(s) of each tube in the bank of tubes can be limited without changing the tube velocity in the upstream (active) section of the tubes. Accumulator 8, adapter 51 and port 21 are shown in detail view in FIG. 9.

Figure 8:
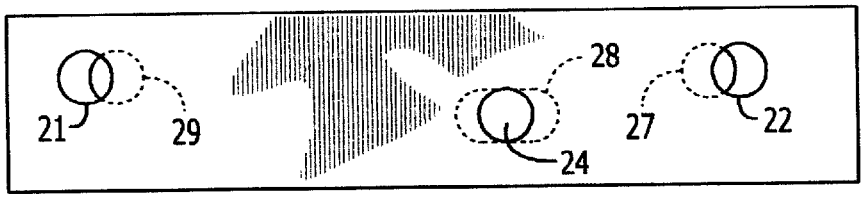
FIG. 8 view of outer body openings (ports 21, 22 & 24) overlaying ports 27, 28 & 29.

Aligning the opening between inner and outer valve ports (i.e. positioning of the openings in the inner and outer valve as shown in FIG. 8) will allow all the water in the upstream section of the tube to flow back into the downstream section of the tube. Decreasing the effective opening of ports 22 & 27 and increasing the effective opening of ports 21 & 29 FIG. 8 will divert a portion of the upstream flow and send it directly back to the outlet (return) manifold 12 FIG. 1 through the bypass 9 FIG. 1 and thus diminish the flow of water in the downstream section as compared to the upstream section.

The design specification for individual modulators can vary so as to vary the flow characteristic of the system, i.e. certain tubes may be functioning with a varying flow while flow in other tubes in the same coil may remain constant or vary proportionately. The location (positioning) and shape of ports allow for this. If for example one set of openings (corresponding to one set of tubes in the bank) is tapered and another set of openings is circular, then movement of the actuator arm can divert flow in equal or varying proportions throughout the bank of tubes. Port location and shape can create opening and closing sequences to provide a variety of heat transfer characteristics to meet changing system requirements over time without replacing the coil assembly.

There are three ways in which water coils are used in the heating/ac industry. For heating only, utilizing hot water, cooling only; utilizing chilled water, and for both heating and cooling in what is called a changeover system where the heating and cooling medium is changed depending on the system need. The modulator described herein is intended to be used primarily for the changeover and heating only applications. In the heating application it is important to maintain a relatively high flow rate to prevent freezing in cold climates. When there is no danger of freezing, it is desirable to minimize the flow rate to reduce energy consumption. Varying the arrangement and shape of ports in the inner valve provide the design engineer options to optimize performance of heating and cooling systems to produce efficient system operation unattainable with prior art.

Note that depending on the placement of the modulator (see FIG. 6) the number of upstream and downstream sections that will experience diminished flow will vary. With the modulator in position 30, one upstream section can maintain, maximum flow while other sections (3 downstream) can be modulated to any desired flow rate. In position 31, three sections can maintain maximum flow while one can be modulated to any desired flow rate. In position 32, the number of upstream and downstream sections is the same (2 and 2). Such number varies with the placement of the modulator as can be seen by those skilled in the art.

It should be noted that the volume of water flowing through the coil assembly may be modulated to zero, for energy conservation, when the system is satisfied and no flow is necessary.

I claim:

1. A coil bypass return apparatus connected to an intermediate portion of heat transfer coils that comprise a bank of tubes, said bank of tubes having an inlet header and an outlet header for the flow of fluid through said bank, said coil bypass return apparatus having an outer valve body having inlet ends and outlet ends connected to each of said tubes in said bank of tubes, each of said tubes having at least one upstream section where fluid flows away from said inlet header towards said inlet ends of said outer valve body, and at least one downstream section where fluid flows towards said outlet header from said outlet ends of said outer valve body, said outer valve body having an inner valve body disposed therein, each of said inner and outer valve bodies having a plurality of ports corresponding to each of said inlet ends and said outlet ends of said tubes and each of said inner and outer valve bodies each having a bypass port, said inner valve body having an actuator arm connected with said inner valve body and having means for rotating said inlet and outlet ports of said inner valve body in relation to said inlet and outlet ports of said outer valve body so as to vary the amount of fluid flow through said downstream sections of said tubes in relation to the amount of fluid flow through said upstream section of tubes by varying the overlapping cross-sections of said inlet and outlet ports and said bypass ports of said inner and outer valve bodies.

* * * * *